US008408123B2

(12) United States Patent
Novak et al.

(10) Patent No.: US 8,408,123 B2
(45) Date of Patent: Apr. 2, 2013

(54) APPARATUS AND METHOD FOR CONTROLLING ROLLER NIP FORCE

(75) Inventors: James Novak, Evansville, WI (US); Sean Garster, Wauwatosa, WI (US)

(73) Assignee: Neschen Americas MD (US)

( * ) Notice: Subject to any disclaimer, the term of this patent is extended or adjusted under 35 U.S.C. 154(b) by 399 days.

(21) Appl. No.: 12/732,860

(22) Filed: Mar. 26, 2010

(65) Prior Publication Data

US 2010/0263559 A1 Oct. 21, 2010

Related U.S. Application Data

(60) Provisional application No. 61/170,342, filed on Apr. 17, 2009.

(51) Int. Cl.
*B41F 5/00* (2006.01)

(52) U.S. Cl. ..... 101/216; 100/162 B

(58) Field of Classification Search ..... 101/182, 101/184, 185, 216, 218, 247; 100/46, 162 B, 100/163 A See application file for complete search history.

(56) References Cited

U.S. PATENT DOCUMENTS

| | | | | |
|---|---|---|---|---|
| 2,261,740 | A | 11/1941 | Makarius | |
| 2,578,413 | A * | 12/1951 | Ford | 101/216 |
| 3,610,013 | A * | 10/1971 | Pillon | 72/238 |
| 4,299,162 | A * | 11/1981 | Hartmann et al. | 100/43 |
| 4,487,122 | A * | 12/1984 | George et al. | 101/153 |
| 4,637,109 | A | 1/1987 | Bryer | |
| 5,022,322 | A * | 6/1991 | Keller | 101/148 |
| 5,052,294 | A | 10/1991 | Bachmeir et al. | |
| 5,329,849 | A | 7/1994 | Roerig | |
| 5,419,242 | A | 5/1995 | van Haag | |
| 6,659,152 | B1 * | 12/2003 | Miyake | 156/555 |

* cited by examiner

*Primary Examiner* — Ren Yan
(74) *Attorney, Agent, or Firm* — Drinker Biddle & Reath LLP

(57) ABSTRACT

A device to provide a moment loading to one roller of a pair of nip rollers to counteract the bending moment created by a nip force between the rollers, the one roller being rotatably supported by a journal bearing at each end thereof, the device comprising a lever mechanism for imparting translational and torsional movement to the journal bearing with respect to a frame.

8 Claims, 2 Drawing Sheets

APPARATUS AND METHOD FOR CONTROLLING ROLLER NIP FORCE

CROSS REFERENCE TO RELATED APPLICATIONS

This application claims priority under 35 U.S.C. §119(e) to U.S. Provisional Application No. 61/170,342, filed on Apr. 17, 2009, which is incorporated by reference herein in its entirety.

FIELD OF THE INVENTION

The present invention relates to laminating and printing machine rollers, and more particularly to an arrangement to prevent uneven nip force along the web due to reaction forces bending the rollers apart.

BACKGROUND

Deflection rollers are used in many printing and laminating machines. The journal ends of the shaft of the paired cylinders are mounted in journal bearings. The bearings on one or both of the cylinders are attached to a moveable arm to move the cylinders into and out of contact with each other and to set the pressure applied to the web at the nip point. The frictional driving force on the web produces an equal reaction force on the cylinders. Since the cylinder shafts are fixed at the ends, this reaction force produces a torque that increases proportional to the distance from the fixed end points, becoming greatest toward the middle and tending to causing a bend of the roller cylinders that can result in uneven nip pressure across the web. If no compensation is made to counter the roller bending, the web will be stretched at the edges more than in the center, creating a risk of tearing or wrinkling. The uneven pressure caused by the bending can also result in non-uniform transfer of ink or creases in the lamination.

There have been many techniques developed to compensate for the torque and reduce the bending. In heavier roller assemblies, mid-point or intermediate bearings for the shaft inside the roller cylinder may have an adjustable eccentric collar to produce a counterforce at the bearings, as described in U.S. Pat. Nos. 2,261,740 and 4,637,109. Another known technique is to pre-set a counter torque on the shaft by adjustable angle journal boxes for the shafts, for example by changing the angle of the bearings by way of adjustment screws in the bearing sleeve, as described in U.S. Pat. No. 5,052,294. The torque can also be applied by an eccentric bearing.

Another technique has been the use of crowned roller surfaces, where the elastic cover of the roller tapers from a higher crown in the center section to a reduced diameter toward the ends. The term "crown" is usually used to denote the shape or diameter profile of the roller necessary to compensate for deflection in order to maintain a uniform nip pressure distribution. Since roller deflection is dependant upon the roll dimensions, the elastic material, and the load applied, the crowning profile is generally matched to a particular roller configuration and constant operating loads. Common profiles can be roughly approximated using a 70 degree cosine curve to approximate the bending curve of a simple beam under uniform load. In heavier loads, rollers with long lengths may start with a longer profile up to a 90 degree cosine curve. Even after approximating the profile, however, the crown is usually adjusted by experimenting with nip impression paper to get the finished crown.

Since the crown profile is selected to optimize uniform pressure under a fixed set of conditions, changing the nip pressure for any reason is likely to reduce the uniformity. With relatively long slender rolls as often used in laminating machinery and some printers, it may be useful or necessary to increase the nip pressure depending upon the thickness of the laminating films or other web materials and the selected operating speed. Consequently, it would be useful to have a convenient method and versatile apparatus that can compensate for these pressure variations over a wide range of conditions.

BRIEF SUMMARY

In a pair of roller cylinders supported at each end thereof by a journal bearing attached to moveable arms for moving the cylinders into and out of contact with each other and setting the internal nip force (the pressure at the nip point), a cam and lever mechanism is provided to apply an adjustable torque to the journal bearing to produce a bending moment in the cylinders that is counter to the internal bending moment produced by the rolling contact of the cylinders. The external bending moment is proportionally adjusted when increasing or decreasing an external nip force applied to the cam and lever mechanism. The lever arm on which the cam is mounted has selectable attachment holes to increase or decrease the effective length of leverage. The bending moment can be easily set up in the static condition to accommodate variations in the thickness of the web and to then make adjustments to the internal nip force or pressure at operating speeds while maintaining the nip pressure uniformity across the roller nip axis.

A device is disclosed for providing a moment loading to one roller of a pair of nip rollers to counteract the bending moment created by a nip force between the rollers, the one roller being rotatably supported by a journal bearing at each end thereof. The device includes a lever mechanism for imparting translational and torsional movement to the journal bearing with respect to a frame.

A device is disclosed for providing a moment loading to one roller of a pair of nip rollers to counteract the bending moment created by a nip force between the rollers, the one roller being rotatably supported by a journal bearing assembly at each end thereof, the journal bearing assembly being movable with respect to a frame. The device includes a mounting arm having a journal end and a lever end, a connecting arm supported by the frame such that the connecting arm is movable in a direction substantially perpendicularly to the frame, and a lever arm pivotable about an axle supported at one end by the connecting arm and at an opposite end by the mounting arm proximal to the lever end. The journal bearing assembly is connected to the mounting arm proximal to the journal end so as to be translationally and rotationally moveable via the journal end of the mounting arm. A roller cam is rotatably supported by a first portion of the lever arm and a pull rod is supported by a second portion of the lever arm, the first and second portions of the lever arm being disposed on opposite sides of the lever arm with respect to the axle. When a force is applied to the pull rod in one direction, the lever arm forces the roller cam against the frame, thereby urging the lever end of the mounting arm away from the frame such that the journal end of the mounting arm imparts a torque to the journal bearing to increase the nip force between the rollers.

A method is disclosed for providing a moment loading to a pair of nip rollers that is equal and opposite to the bending moment created by the nip force between two rollers, each roller being supported at the ends thereof by journal bearings movable with respect to a frame. The method includes applying a torque to the journal bearings supporting a first one of the rollers.

DETAILED DESCRIPTION

Figure 1:
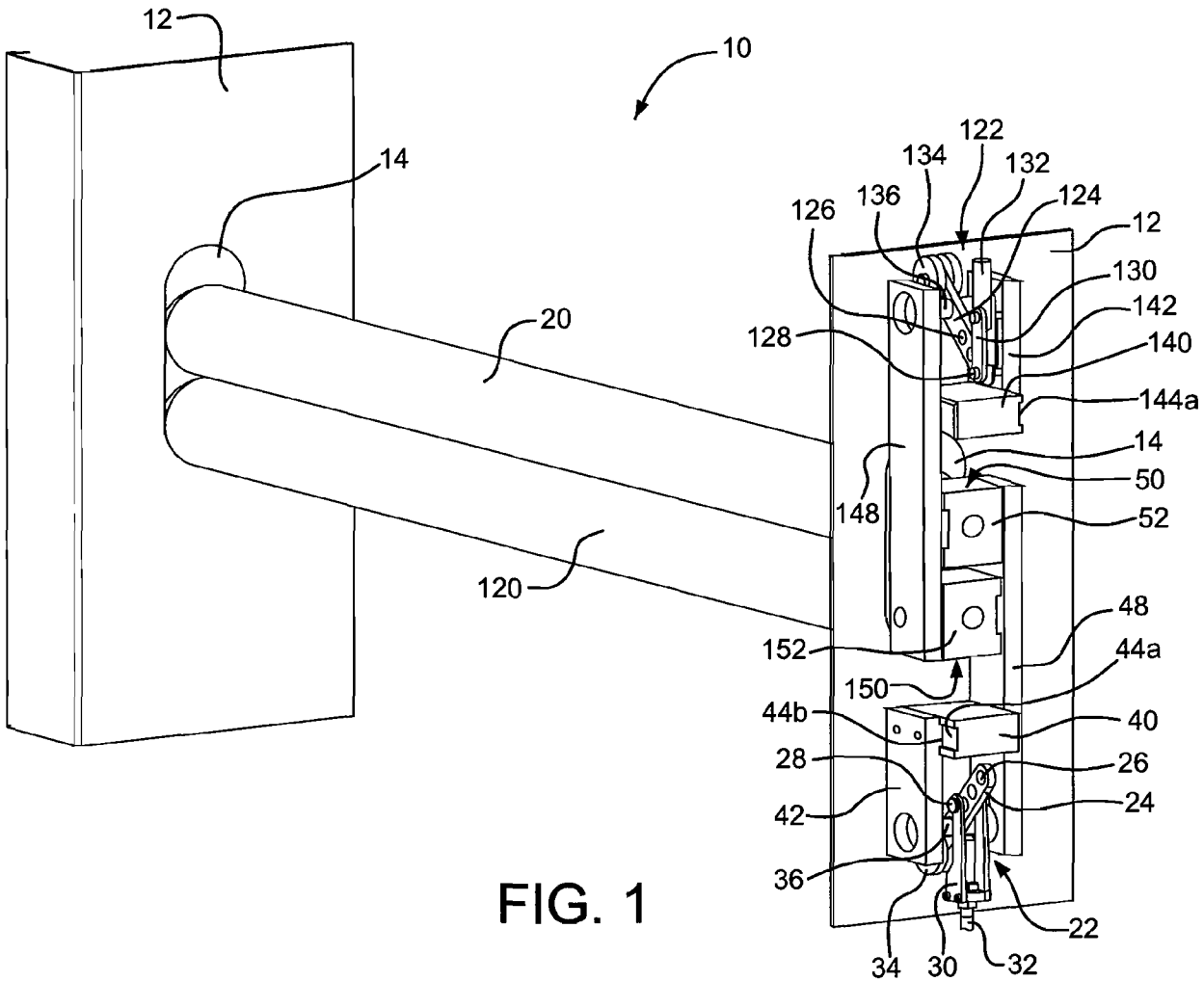
FIG. 1 is an isometric view of a nip roller and an apparatus for controlling the roller nip force and moment loading according to the present invention.

FIG. 1 shows a nip roller device 10 applied to a simple two cylinder roller system. It should be understood that web processing machinery such as printing and laminating machines many have multiple sets of rollers, some of which are pairs and others of ganged cylinders in different arrangements. For easy of understanding this invention, the device 10 is depicted as used on a sample roller pair. For purposes of this description, one of the cylinders 20 is referred to as a top cylinder and the other as a bottom cylinder 120, although the orientation need not always be vertical. The cylinders 20, 120 are typically hollow. Note also that FIG. 1 shows the rear side of a laminator machine frame 12 at one end of the roller pair. The drawing should be understood to have a similar configuration on the frame 12 at the other end of the rollers.

Force and torque are applied to the top cylinder 20 by actuating a bottom pull rod 32 connected via a cam and lever mechanism 22 to journal bearing assemblies 50 at either end of the cylinder 20. In most instances, the bottom cylinder 120 will be held in a fixed position during operation of the top cylinder 20 by locking a top pull rod 132, which is connected via a cam and lever mechanism 122 to journal bearing assemblies 150. The static nip force and any nip force adjustments made when the web is running is usually provided through the pull rod 32.

Although not depicted, it should be understood that the forces applied to the pull rods 32, 132 can be produced by hydraulic or other mechanical means. The forces applied by the pull rods 32, 132 at the ends of the cylinders 20, 120 is sometimes referred to as the external nip force. The reaction to the external nip force across the nip axis of the cylinders 20, 120 is then referred to as the internal nip force.

When the web is stopped, the internal nip force and external nip force are static. Once the web is in motion, these opposing forces increase due to reaction to the friction of the moving web. The effect of the static nip force applied at the ends of the cylinders 20, 120 and the friction component across the nip axis is well known to produce a bending moment in the shafts of the cylinders 20, 120 that tends to move the cylinders 20, 120 apart toward the middle of the nip axis. This reduced pressure in the center can cause the edges of a film web to stretch or tear, or can cause creases in the film. The device 10 solves this problem by changing the angle of the journal bearings using pull rods connected to moveable arms on which the journal bearings are mounted by a cam and lever arm arrangement.

Figure 2:
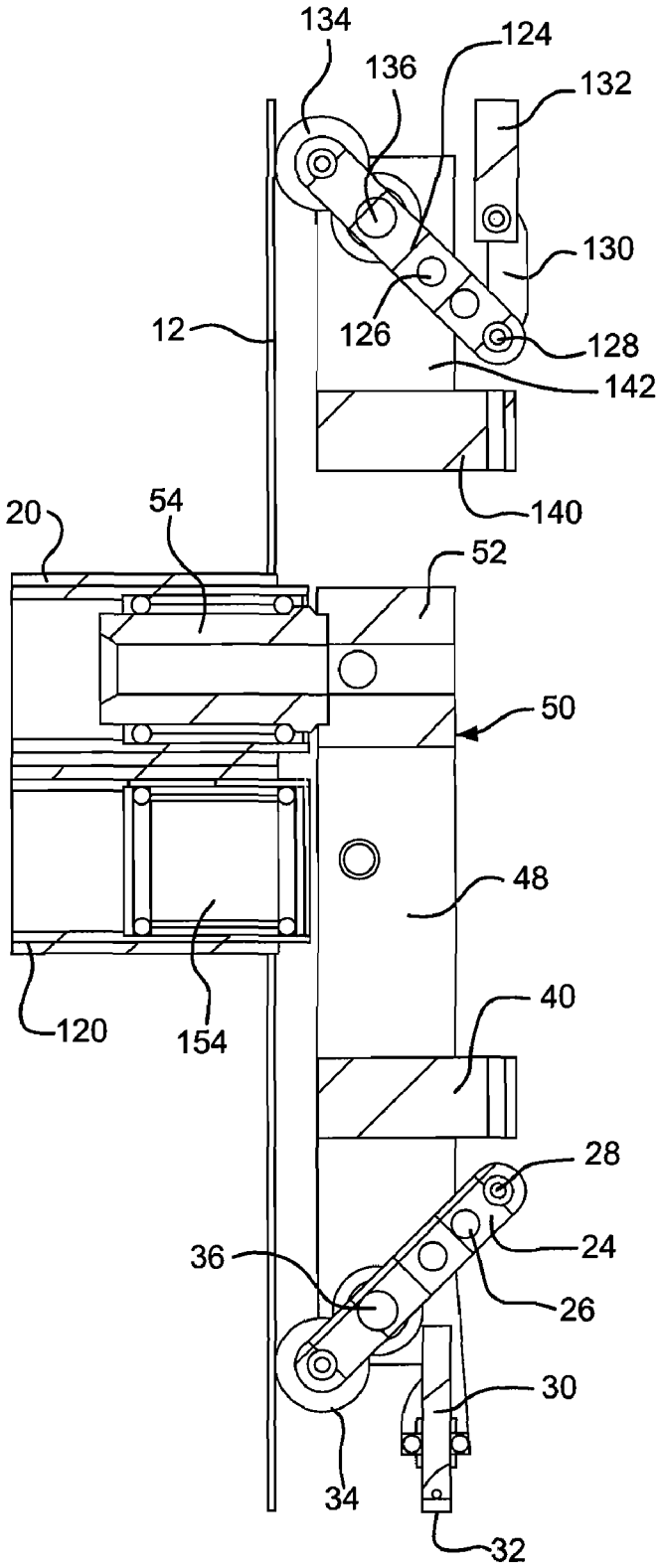
FIG. 2 is an elevation partial section view of a nip roller and apparatus as in FIG. 1.

In the embodiment shown in FIG. 2, the hollow cylinders 20, 120 are supported not by internal shafts but by the journal bearing assemblies 50, 150, respectively. Each journal bearing 50, 150 includes a journal bearing sleeve 52, 152 and a journal bearing 54, 154 disposed inside an end of its respective hollow cylinder 20, 120. The end of each bearing 54, 154 has a short journal-like shaft that extends to the sleeve 52, 152 holding the bearing 54, 154. Alternatively, the system could use a more typical setup in which an internal shaft runs the length of each hollow cylinder 20, 120, the internal shafts having journal ends that are mounted in or to journal bearings supported by journal sleeves at the ends of the hollow cylinders 20, 120. In either configuration, journal ends of the cylinder 20, 120 are mounted in or to journal bearings 54, 154 and bearing sleeves 52, 152 forming bearing assemblies 50, 150 that are attached to a lever end of movable mounting arms 48, 148.

Force to move the cylinders 20, 120 into and out of contact with each other and to set the static pressure at the nip point (the junction between the two roller cylinders 20, 120) is provided through pull rods 32, 132 connected to the respective mounting arms 48, 148. In a conventional set up of this type, the pull rods 32, 132 would be at a fixed connection to the moveable arms 48, 148 so as to apply a straight line force to the arms 48, 148. In the present invention, however, the pull rods 32, 132 are connected to the respective moveable arms 48, 148 by a lever mechanism 22, 122, which is essentially a cam and lever arm arrangement described in more detail below, that can be used to apply a selectable torque on the journal bearing assemblies 50, 150 that in turn produces a bending moment on the cylinder shafts 20, 120.

The following description of the structure of the device 10 will be done with respect to only the hollow cylinder 20, it being understood than an identical mechanism exists with respect to the hollow cylinder 120, as shown in the figures, with each reference numeral being identical except for being in the 100 series.

The lever mechanism 22 operates to apply leverage between the frame 12 and the mounting arm 48. A bracket 40 includes an undercut groove **44*a* extending along the bracket 40 substantially perpendicularly to the frame 12. A short connecting arm 42 extends substantially parallel to the frame 12. The arm 42 includes a tongue 44*h* for slidingly mating with the groove 44*a* in the bracket 40 so as to permit the arm 42 to slide generally toward and away from the frame 12 while remaining substantially parallel to the frame 12. The mating between the tongue 44*a* and groove 44*b* allows for sufficient play that the arm 42 can skew or deviate slightly from parallel to the frame 12 while still being generally constrained to move in a direction toward and away from the frame 12**.

An axle 36 interconnects the connecting arm 42 with a lever end of the mounting arm 48, the lever end being at an opposite end of the mounting arm 48 from the journal end. A lever arm 24 is pivotably supported on the axle 36 between the connecting arm 42 and the mounting arm 48. The lever arm 24 extends in both directions from the axle 36. In one direction, a first portion of the lever arm 24 rotatably supports a roller cam 34 that engages the frame 12. In the other direction, a second portion of the lever arm 24 includes several spaced adjustment holes 26 along its length for receiving a pin 28. A pull rod yolk 30, connected to and actuated by the pull rod 32, spans the second portion of the lever arm 24. The pin 28 connects the pull rod yolk 30 to the lever arm 24 via the holes 26 to enable the pull rod 32 to cause the lever arm 24 to pivot about the axle 36 with respect to the frame 12.

In operation, the lever mechanism 22 is used to apply torque to the journal bearing assembly 50 to increase the internal roller nip force as required to maintain adequate tension across the entire film being guided through the roller pair 20, 120. When an outward (tensile) external nip force is applied to the pull rod 30, the pull rod yolk 32 and pin 28 in turn apply a pivoting force to the lever arm 24, causing the lever arm 24 to pivot in a first direction about the axle 36. The pivoting of the lever arm 24 forces the roller cam 34 against the frame, thereby causing an outward reaction force to be applied to the axle 36 to force the axle 36 in a direction away from the frame 12. The outward movement of the axle 36 concomitantly moves the connecting arm 42 and the lever end of the mounting arm 48 away from the frame 12.

The tongue and groove connection 44*a*, 44*b* constrains the direction of movement of the connecting arm 42 and has sufficient rigidity to balance against the torque to be applied to the bearing assembly 50. The length of the connecting arm 42 is preferably kept as short as possible to minimize the amount of torque that must be carried by the tongue and groove connection 44*a*, 44*b*. The journal end of the mounting arm 48 is constrained against movement away from the frame 12 due to its rigid connection to the bearing assembly 50. Therefore, the journal end of the mounting arm 48 remains translationally fixed with respect to the frame 12 while the lever end, driven by the force applied via the axle 26, is moved away from the frame 12, thereby creating a torque on the bearing assembly 50.

The torque on the bearing assembly 50, and specifically on the bearing housing 52, is passed to the bearing 54, which causes a torque or bending moment to be applied to the end of the hollow cylinder 20 to create the desired internal nip force. The ratio between the external nip force applied to the pull rod 32 and the internal nip force generated by the bending moment on the roller cylinder 20 can be controlled by adjusting various parameters. In one variation, a shorter mounting arm 48 applies more torque to the bearing assembly 50 per unit movement of the axle 36 away from the frame, and a longer mounting arm 48 applies less torque. In another variation, the pin 28 connecting between the pull rod yolk 30 and the lever arm 24 can be located in one of a number of adjustment holes 26, wherein an adjustment hole farther from the axle 36 provides for a higher ratio of internal-to-external nip force and an adjustment hole closer to the axle 36 provides for a lower ratio of internal-to-external nip force.

Using the device 10, when an increased tensile force is applied to the bottom pull rod 32, the top cylinder 20 receives both a vertical force and a torque which are transferred from the bearing assembly 50 through the journal sleeve 52 and the bearing 54 to the end of the cylinder shaft 20. The bottom cylinder 120 reacts to the increased tensile force applied to the top pull rod 132 in a similar manner. The vertical component of the increased force to the top cylinder 20 produces a reaction force against the bottom cylinder 120 and thus against the top pull rod 132, which in turn in turn produces a torque in the bottom cylinder bearing assembly 150 that transfers though the sleeve 152 and the bearing 154 to the journal end of the bottom cylinder 120. These torque forces at the journal ends produce a bending moment in the cylinder shafts 20, 120 that can cancel out the opposite natural bending moment of the rollers 20, 120 and maintain uniform pressure along the nip point axis.

It should be clear from the above description that this cam and lever arm arrangement allows much easier adjustment of the counter bending moment than having to adjust set screws or eccentric collars or the like, and allows for adjustment to be made while the web is running. The bending moment change is proportional to the nip pressure change. The ability to change the lever arm effective length also allows a range selection of nip pressure to bending moment ratios. This allows a machine such as a film laminator to be more versatile in that it can accommodate a wide range of crowned or uncrowned rollers and web thickness, and operate effectively through a variable range of processing speeds and nip pressures.

The invention claimed is:

1. A device mounted on a frame of a printing or laminating machine to reduce uneven nip force across a pair of deflection rollers by providing a moment loading to one roller of the pair to counteract the bending moment created by a nip force between the rollers, the one roller being rotatably supported by a journal bearing at each end thereof, the device comprising a lever mechanism for imparting translational and torsional movement to the journal bearing with respect to the frame;

wherein the lever mechanism includes:

a lever arm pivotable about an axle to cause the axle to move generally perpendicularly with respect to the frame when a force is applied to a first portion of the lever arm; and a connecting arm connecting between the axle and the journal bearing such that when the axle moves toward or away from the frame, the connecting arm pivots with respect to the journal bearing, imparting a torque to the journal bearing; and wherein a second portion of the lever arm disposed opposite the axle from the first portion of the lever arm contacts and transmits force to the frame.

2. The device of claim 1, further including two or more spaced apart adjustment holes disposed in the first portion of the lever atm for adjustably connecting a pull rod, such that the torque applied to the journal bearing can be adjusted by connecting the pull rod to a different one of the adjustment holes.

3. The device of claim 1, the second portion of the lever arm further including a roller cam supported by the second portion of the lever arm, the roller cam contacting and transmitting force to the frame.

4. The device of claim 1, further including a bracket for slidably supporting the connecting arm.

5. The device of claim 4, wherein the bracket has a groove disposed substantially perpendicularly to the frame and a mounting arm has a mating tongue that is received into the groove.

6. A device to provide a moment loading to one roller of a pair of nip rollers to counteract the bending moment created by a nip force between the rollers, wherein the one roller is rotatably supported by a journal bearing assembly at each end thereof and the journal bearing assembly is movable with respect to a frame, the device comprising:

a mounting arm having a journal end and a lever end, the journal bearing assembly being connected to the mounting arm proximal to the journal end thereof;

a connecting arm supported by the frame to be movable in a direction substantially perpendicularly to the frame; and a lever arm pivotable about an axle supported at one end by the connecting arm and at an opposite end by the mounting arm proximal to the lever end thereof, a roller cam being rotatably supported by a first portion of the lever arm and a pull rod being supported by a second portion of the lever arm, the first and second portions of the lever arm extending in opposite directions from the axle;

wherein when a force is applied to the pull rod in one direction, the lever arm forces the roller cam against the frame, thereby urging the lever end of the mounting arm away from the frame such that the journal end of the mounting arm imparts a torque to the journal bearing assembly to increase the nip force between the rollers.

7. The device of claim 6, further comprising a bracket mounted to the frame, the bracket having a groove disposed substantially perpendicularly to the frame for slidably supporting a mating tongue on the connecting arm.

8. A method for providing a moment loading to a pair of nip rollers that is equal and opposite to the bending moment created by the nip force between two rollers, each roller being supported at the ends thereof by journal bearings movable with respect to a frame, the method comprising actuating a lever mechanism to apply the nip force and a torque to the journal bearings supporting a first one of the rollers, the torque causing a relative rotational movement between the journal bearing and the frame;

wherein the lever mechanism includes:

a lever arm pivotable about an axle to cause the axle to move generally perpendicularly with respect to the frame when a force is applied to a first portion of the lever arm; and a connecting arm connecting between the axle and the journal bearing such that when the axle moves toward or away from the frame, the connecting arm pivots with respect to the journal bearing, imparting a torque to the journal bearing; and wherein a second portion of the lever arm disposed opposite the axle from the first portion of the lever arm contacts and transmits force to the frame.

* * * * *